US008740415B2

(12) United States Patent
Wheelock

(10) Patent No.: US 8,740,415 B2
(45) Date of Patent: Jun. 3, 2014

(54) PARTITIONED HEATSINK FOR IMPROVED COOLING OF AN LED BULB

(75) Inventor: Glenn Wheelock, San Jose, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 188 days.

(21) Appl. No.: 13/068,867

(22) Filed: Jul. 8, 2011

(65) Prior Publication Data

US 2013/0010480 A1 Jan. 10, 2013

(51) Int. Cl.
*F21V 29/00* (2006.01)

(52) U.S. Cl.
USPC ..... 362/294; 362/373

(58) Field of Classification Search
USPC ..... 362/294, 249.02, 373; 361/719
See application file for complete search history.

(56) References Cited

U.S. PATENT DOCUMENTS

| | | | | |
|---|---|---|---|---|
| 6,999,312 | B1 | 2/2006 | Garnett et al. | |
| 7,581,856 | B2 * | 9/2009 | Kang et al. | 362/373 |
| 7,824,075 | B2 * | 11/2010 | Maxik | 362/294 |
| 8,038,329 | B2 | 10/2011 | Takahasi et al. | |
| 8,083,383 | B2 * | 12/2011 | Chen | 362/373 |
| 8,272,766 | B2 * | 9/2012 | Phipps et al. | 362/294 |
| 8,274,241 | B2 | 9/2012 | Guest et al. | |
| 8,282,250 | B1 | 10/2012 | Dassanayake et al. | |
| 8,591,063 | B2 * | 11/2013 | Yoneda | 362/249.02 |
| 2008/0013316 | A1 * | 1/2008 | Chiang | 362/264 |
| 2009/0046473 | A1 | 2/2009 | Tsai et al. | |
| 2009/0141508 | A1 | 6/2009 | Peng et al. | |
| 2010/0096992 | A1 * | 4/2010 | Yamamoto et al. | 315/112 |
| 2010/0149807 | A1 | 6/2010 | Hu et al. | |
| 2011/0089830 | A1 | 4/2011 | Pickard et al. | |
| 2012/0146481 | A1 * | 6/2012 | Li et al. | 313/46 |
| 2012/0188745 | A1 * | 7/2012 | Yoneda | 362/84 |

FOREIGN PATENT DOCUMENTS

| | | | |
|---|---|---|---|
| JP | 2008/204671 | * | 4/2008 |
| JP | 2008/293753 | * | 4/2008 |

OTHER PUBLICATIONS

International Search Report and Written Opinion received for PCT Patent Application No. PCT/US2012/045849, mailed on Oct. 1, 2012, 7 pages.

Non-Final Office Action received for U.S. Appl. No. 13/543,713, mailed on Aug. 13, 2013, 10 pages.

* cited by examiner

*Primary Examiner* — Peggy A. Neils
(74) *Attorney, Agent, or Firm* — Morrison & Foerster LLP

(57) ABSTRACT

A light emitting diode (LED) bulb has a shell. An LED is within the shell. The LED is electrically connected to a driver circuit, which is electrically connected to a base of the LED bulb. The LED bulb also has a heatsink between the shell and base. A thermal break partitions the heatsink into an upper partition adjacent the shell and a lower partition adjacent the base.

20 Claims, 6 Drawing Sheets

PARTITIONED HEATSINK FOR IMPROVED COOLING OF AN LED BULB

BACKGROUND

1. Field

The present disclosure relates generally to a heatsink for a light emitting diode (LED) bulb, and more specifically to a partitioned heatsink for improved cooling of different components of a LED bulb.

2. Description of Related Art

Traditionally, lighting has been generated using fluorescent and incandescent light bulbs. While both types of light bulbs have been reliably used, each suffers from certain drawbacks. For instance, incandescent bulbs tend to be inefficient, using only 2-3% of their power to produce light, while the remaining 97-98% of their power is lost as heat. Fluorescent bulbs, while more efficient than incandescent bulbs, do not produce the same warm light as that generated by incandescent bulbs. Additionally, there are health and environmental concerns regarding the mercury contained in fluorescent bulbs.

Thus, an alternative light source is desired. One such alternative is a bulb utilizing an LED. An LED comprises a semiconductor junction that emits light due to an electrical current flowing through the junction. Compared to a traditional incandescent bulb, an LED bulb is capable of producing more light using the same amount of power. Additionally, the operational life of an LED bulb is orders of magnitude longer than that of an incandescent bulb, for example, 10,000-100,000 hours as opposed to 1,000-2,000 hours.

The lifetime and performance of an LED bulb depends, in part, on its operating temperature. The lifetime of the LED bulb driver circuit may limit the overall lifetime of the LED bulb if the driver circuit operates at high temperature for long periods of time. Similarly, the lifetime of the LEDs that produce the light may be reduced by excessive heat. Additionally, high operating temperatures can reduce the light output of the LEDs.

While both the driver circuit and LEDs are sensitive to high operating temperatures, these components are also responsible for generating heat. LEDs are about 80% efficient, meaning that 20% of power supplied to LEDs is lost as heat. Similarly, the driver circuit that supplies current to the LED is about 90% efficient, meaning that 10% of the power supplied to it is lost as heat.

The operating temperature of a LED bulb depends on many factors. For example, each individual LED produces heat. Therefore, the number and type of LEDs present in the bulb may affect the amount of heat the LED bulb produces. Additionally, driver circuitry may also produce significant amounts of heat.

Other factors may determine the rate at which generated heat is dissipated. For example, the nature of the enclosure into which the LED bulb is installed may dictate the orientation of the LED bulb, the insulating properties surrounding the LED bulb, and the direction of the convective air stream flowing over the LED bulb. Each of these factors may have a dramatic effect on the build up of heat in and around the LED bulb.

Accordingly, LED bulbs may require cooling systems that account for the different sources of heat, the ability of components to withstand elevated temperatures, and the variables associated with the dissipation of heat.

BRIEF SUMMARY

One embodiment of a light emitting diode (LED) bulb has a shell. An LED is within the shell. The LED is electrically connected to a driver circuit, which is electrically connected to a base of the LED bulb. The LED bulb also has a heatsink between the shell and base. A thermal break partitions the heatsink into an upper partition adjacent the shell and a lower partition adjacent the base.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Figure 1:
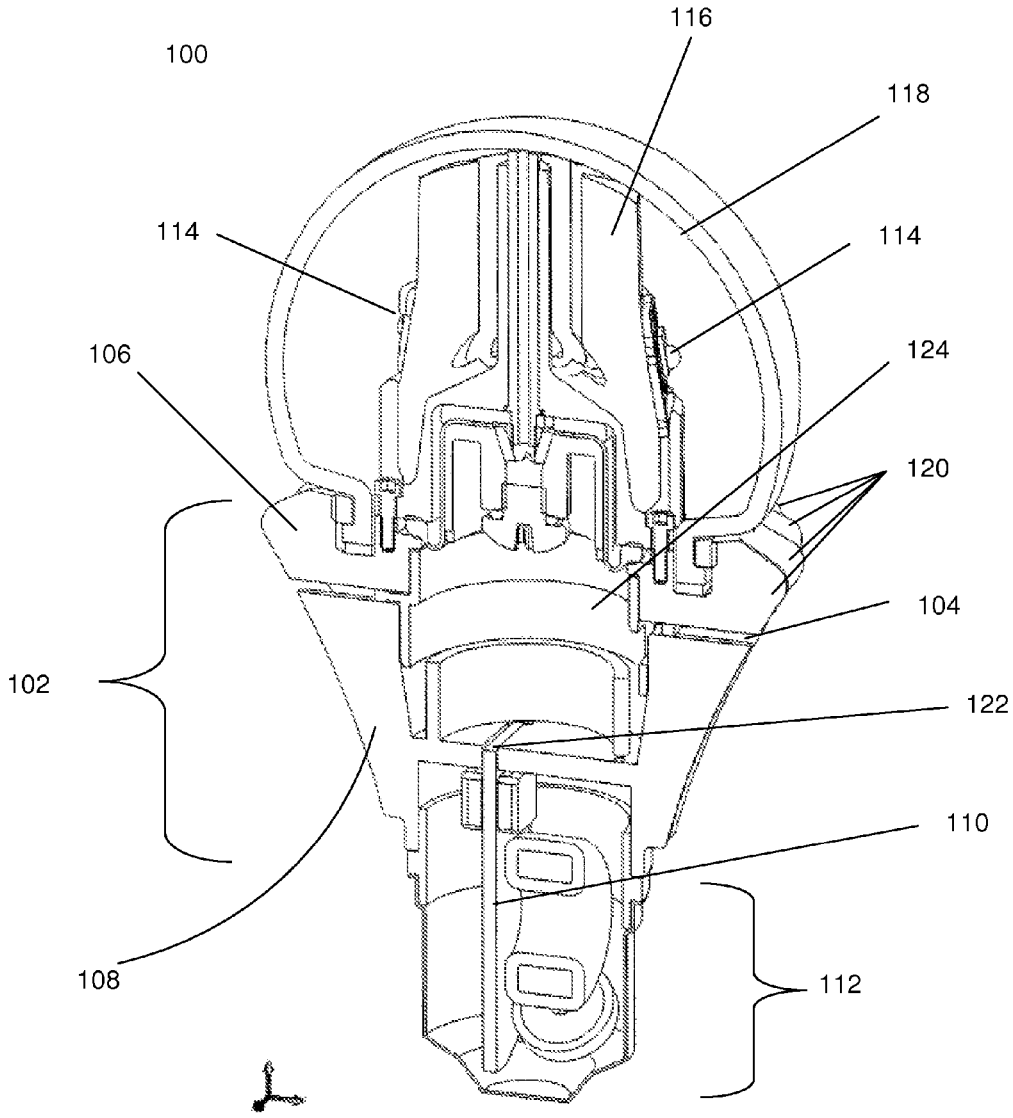
FIG. 1 depicts an exemplary embodiment of an LED light bulb with a partitioned heatsink.

FIG. 1 depicts an exemplary embodiment of LED bulb 100 using partitioned heatsink 102 for improved cooling. Thermal break 104 partitions heatsink 102 into upper heatsink partition 106 and lower heatsink partition 108. The amount of heat that may be dissipated by each partition depends, in part, on the amount of surface area that is exposed away from the bulb. The more surface area exposed to the environment outside of the LED bulb, the more heat that may be dissipated.

Heatsink 102 may be made of any materials that exhibit suitable thermal conductivity. For example, metals such as aluminum or copper are often used for heatsink applications. In this exemplary embodiment, a plurality of fins 120 increases the surface area of the heatsink and helps dissipate heat generated by LED bulb 100 into the surrounding environment. Heatsink 102 may be shaped to make LED bulb 100 resemble a common A19 bulb form factor.

Thermal break 104 may be made by cutting or otherwise removing a portion of heatsink 104 to create a void. Alternatively, heatsink 102 may be fabricated, using metal casting or other suitable manufacturing processes, with thermal break 104 in place.

Thermal break 104 may be maintained with a thermally insulting material that completely or partially fills thermal break 104. For example, as depicted in FIG. 1, thermal break 104 may be maintained by connector piece 124 between upper partition 106 and lower partition 108. Connector piece 124 holds upper partition 106 in proper alignment with lower partition 108 while maintaining thermal break 104 as a void. Depending on how connector piece 124 is shaped connector piece 124 may form part or all of thermal break 124. Suitable materials for connector piece 124 include glass-filled nylon, ceramics, ceramic derivatives, and materials with low thermal conductivity. As an alternative to thermal break 104 being a void, a thermally insulting material may maintain thermal break 104 by partially or completely fill thermal break 104 using injection molding or other suitable manufacturing processes.

Figure 2:
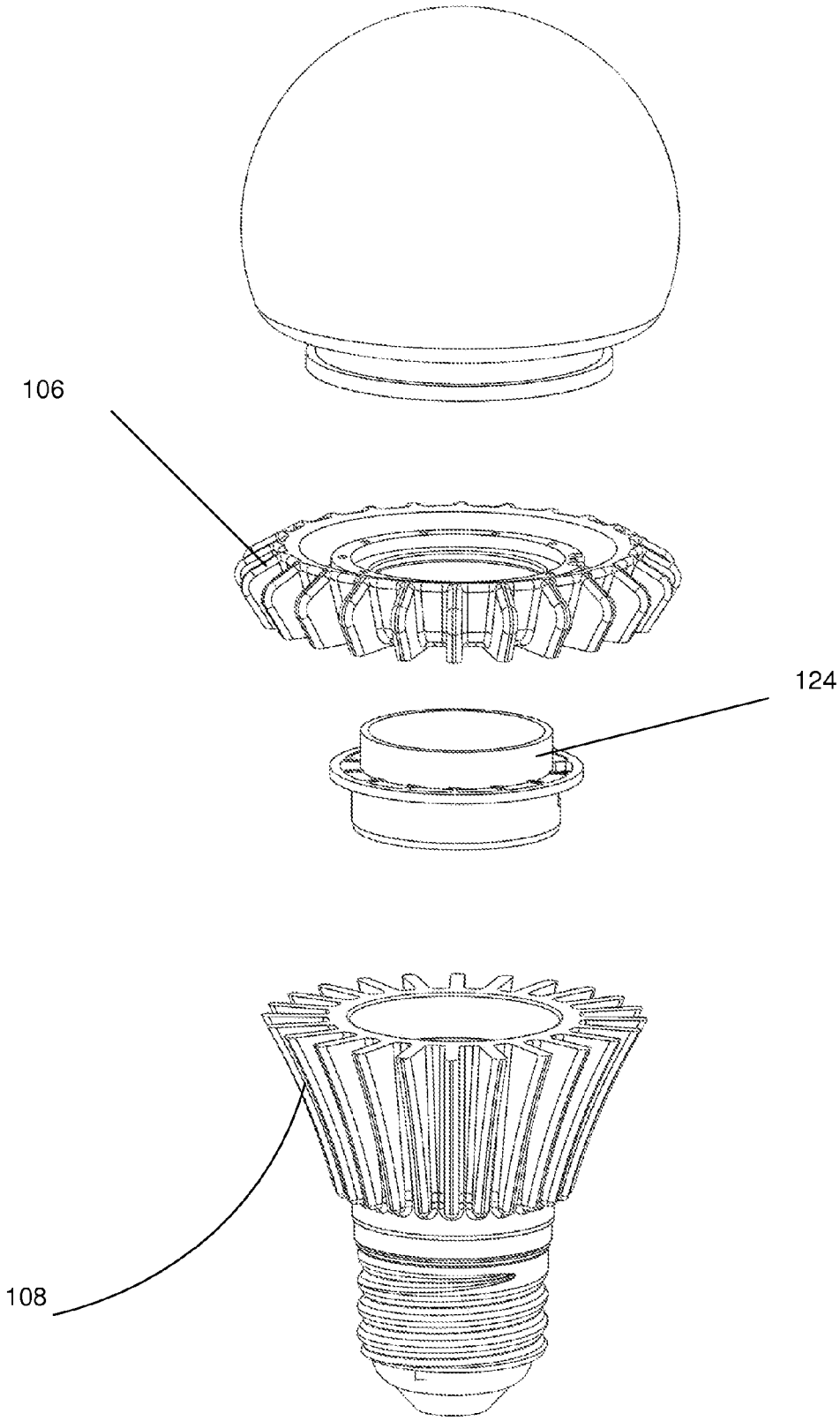
FIG. 2 depicts an exploded view of the exemplary embodiment.

FIG. 2 depicts an exploded view of LED bulb 100. Connector piece 124 forms the thermal break between upper partition 106 and lower partition 108.

Referring back to FIG. 1, the location of thermal break 104 may be selected to allocate portions of heatsink 102 between driver circuit 110 and LEDs 114. The size of the portions allocated to driver circuit 110 and LEDs 114 affects the ability of heatsink 102 to cool those components. Factors that may be considered in allocating the portions heatsink 102 between driver circuit 110 and LEDs 114 include the amount of heat generated by each component, the sensitivity of each component to elevated temperatures, and other paths that each component may have for dissipating heat.

Driver circuit 110, which is located substantially within bulb base 112, controls the drive current delivered to LEDs 114 that are mounted on LED mounts 116, which are disposed within bulb 116. LED mounts 114 may help transfer heat from LEDs 114 to heatsink 102. LED mounts 116 may be formed as part of the heatsink. Alternatively, LED mounts 116 may be formed separate from the heatsink, but are still thermally coupled to the heatsink. As another alternative, LED mounts 116 may be omitted, and the LEDs 114 may be mounted in a manner to thermally couple LEDs 114 to upper partition 106.

Thermal vias or a metal core printed circuit board (PCB) may facilitate heat transfer from drive circuit 110 to heatsink 102 at position 122. For example, in this exemplary embodiment, driver circuit 110 may produce less heat than LEDs 114, but driver circuit 110 may also be more sensitive to high temperatures. Specifically, driver circuit 110 may be able to operating in temperatures up to 90° C. without damage, but LEDs 114 may be able to operate in temperatures up to 120° C. without damage. Additionally, LEDs 114 may be able to dissipate some heat out of shell 118, especially if shell 118 is filled with a thermally conductive liquid. Therefore, in this exemplary embodiment, thermal break 104 is placed to allocate the majority of heatsink 102 in the form of lower heatsink partition 108 to cooling driver circuit 110. The rest of heatsink 104 is allocated to cooling LEDs 114 in the form of upper heatsink partition 106.

In addition to allocating partitions of heatsink 102 to driver circuit 110 and LEDs 114, thermal break 104 may also prevent heat from LEDs 114 from affecting driver circuit 110. Without thermal break 104 heat from LEDs 114 may degrade or damage driver circuit 110 because LEDs 114 produce more heat than driver circuit 110 and driver circuit 110 is more sensitive to heat than LEDs 114.

Figure 3:
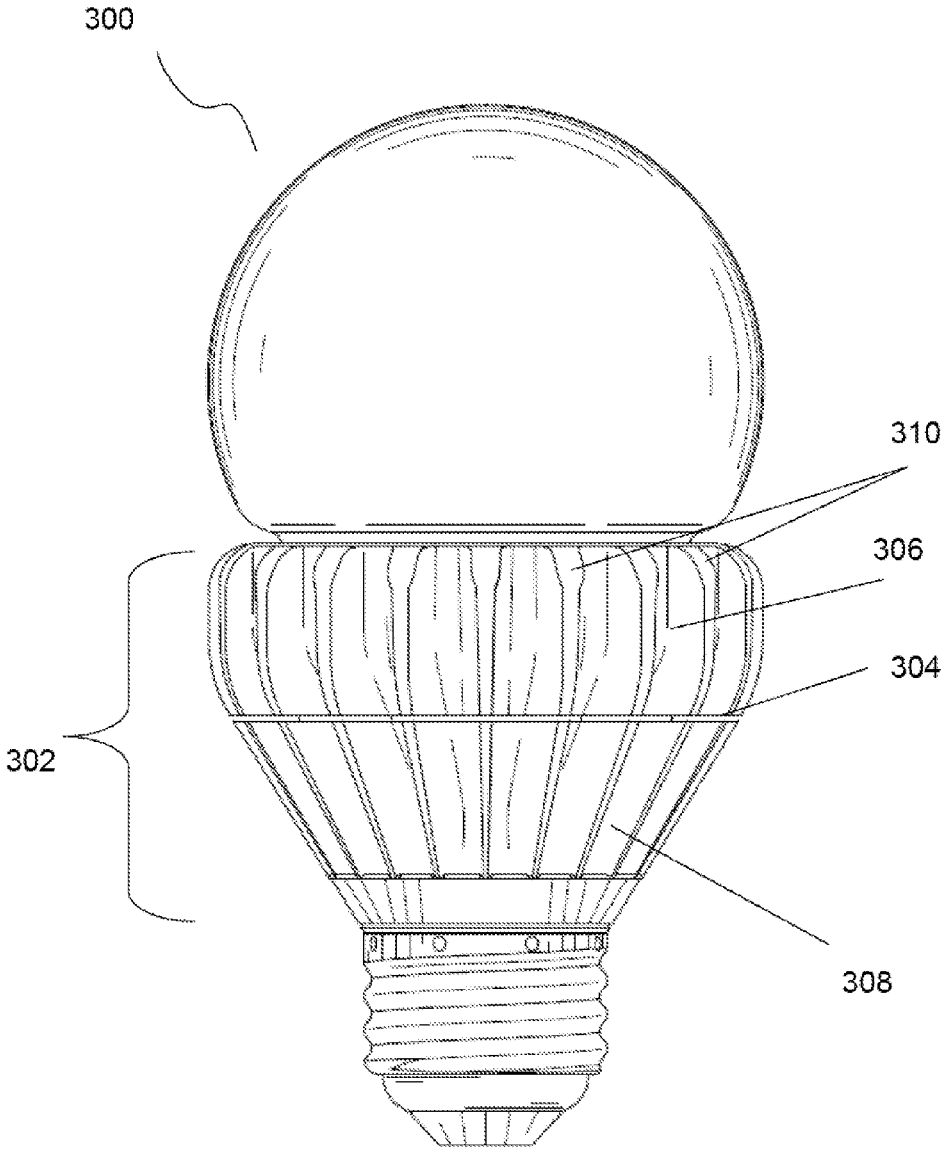
FIG. 3 depicts another exemplary embodiment of an LED light bulb with a partitioned heatsink.

FIG. 3 depicts another exemplary embodiment of LED bulb 300 using partitioned heatsink 302 for optimal cooling. Thermal break 304 partitions heatsink 302 into upper partition 306 and lower partition 308.

Figure 4:
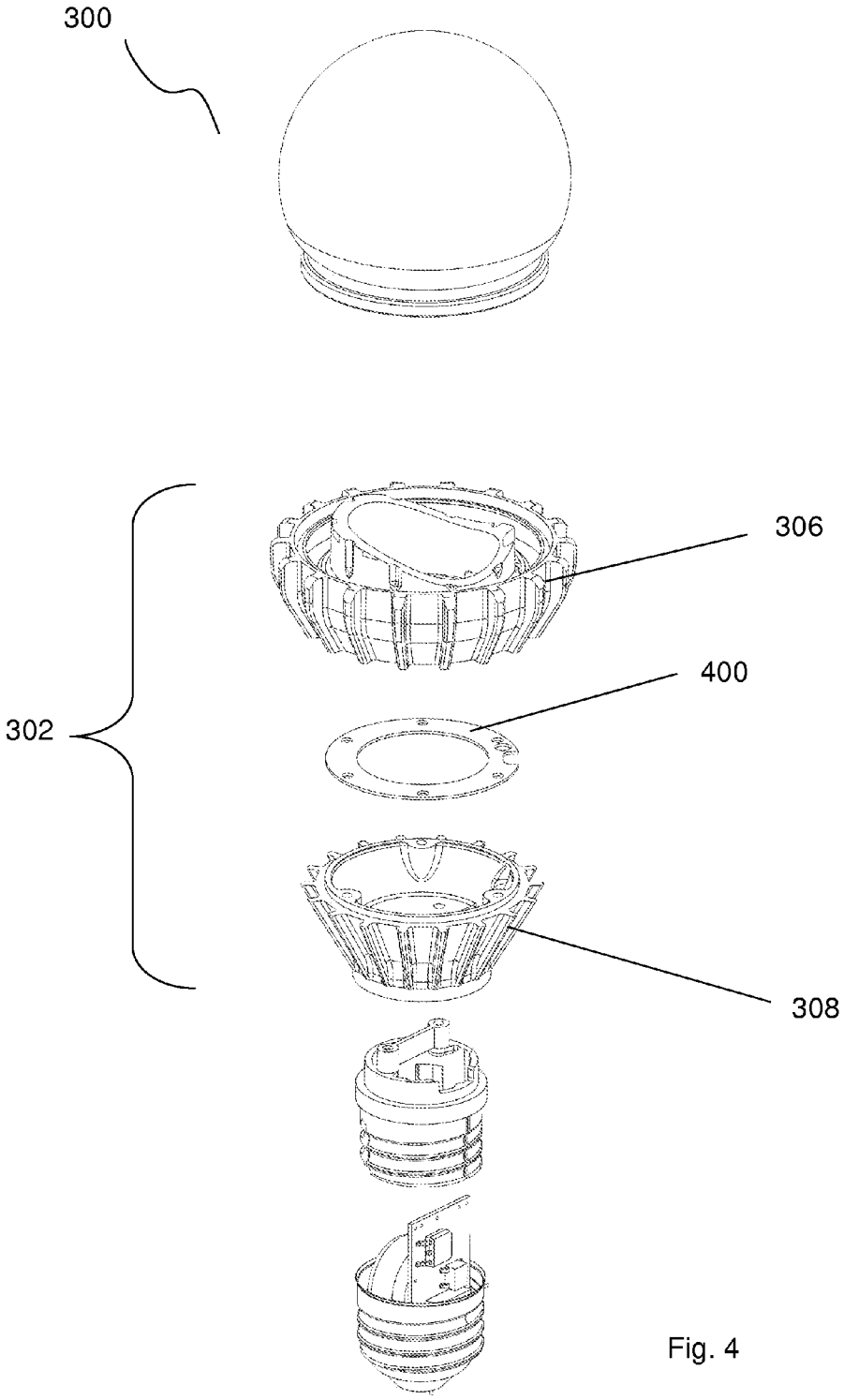
FIG. 4 depicts an exploded view of exemplary embodiment of FIG. 3.

FIG. 4 depicts an exploded view of LED bulb 300. In this exemplary embodiment, connector piece 400 implements thermal break 304.

As compared to heatsink 102 of LED bulb 100 (FIG. 1), heatsink 302 of LED 300 is partitioned so that upper partition 306 is a greater proportion of heatsink 302 as compared to the proportion that upper partition 106 uses of heatsink 102 (FIG. 1). By dedicating more of heatsink 302 to upper partition 306, heatsink 302 may be able to dissipate more heat generated by LEDs of LED bulb 300 as compared to the ability of heatsink 102 to dissipate heat generated by LEDs 114 (FIG. 1).

Figure 5:
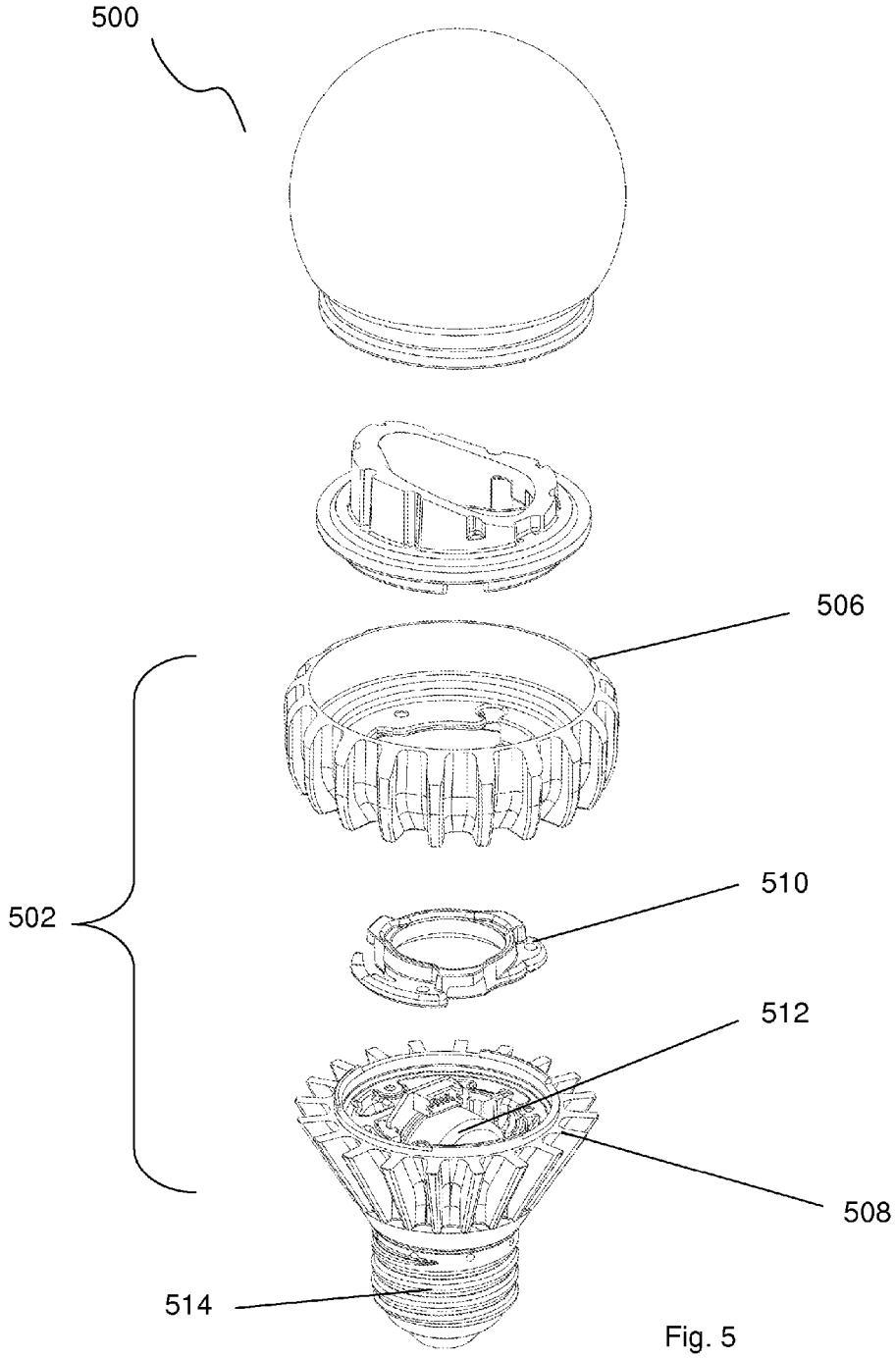
FIG. 5 depicts an exploded view of yet another exemplary embodiment.

FIG. 5 depicts yet another exemplary embodiment of LED bulb 500 using partitioned heatsink 502 for improved cooling. Thermal break 504 partitions heatsink 502 into upper partition 506 and lower partition 508. The amount of heat that may be dissipated by each partition depends, in part, on the amount of exposed surface area. The more surface area exposed to the environment outside of the LED bulb, the more heat that may be dissipated. Connector piece 510 implements thermal break 504. LED bulb 500 includes driver circuit 512 within lower partition 508 and base 514.

Figure 6:
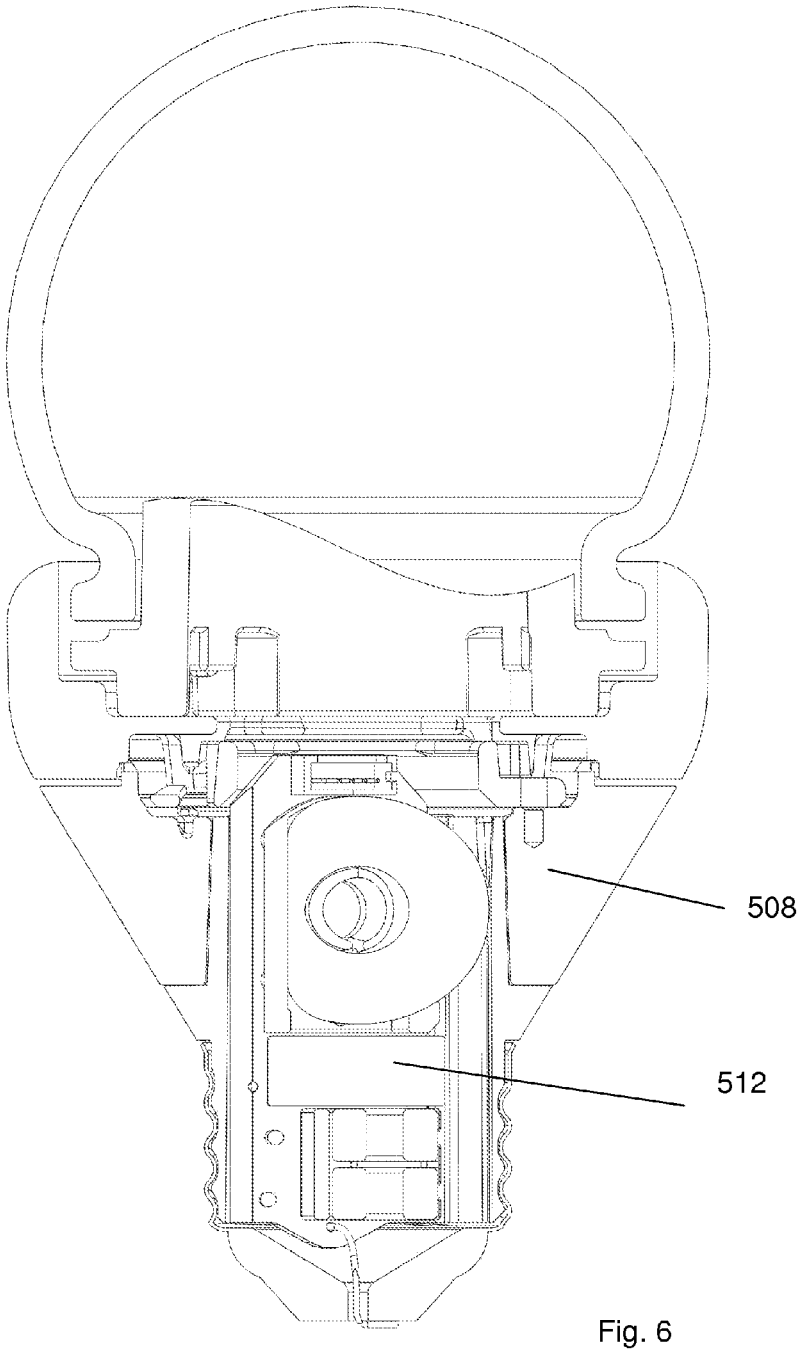
FIG. 6 depicts a cross-section view of the exemplary embodiment of FIG. 5.

FIG. 6 depicts a cross-section of LED bulb 500. As shown in FIG. 6, lower partition 508 substantially surrounds driver circuit 512. This may allow for better heat transfer from driver circuit 512 to lower partition 508, which may allow driver circuit 512 to operate at a cooler temperature.

Although a feature may appear to be described in connection with a particular embodiment, one skilled in the art would recognize that various features of the described embodiments may be combined. Moreover, aspects described in connection with an embodiment may stand alone.

What is claimed is:

1. A light emitting diode (LED) bulb comprising:
a shell;
an LED within the shell;
a driver circuit electrically connected to the LED;
a base electrically connected to the LED driver circuit; and
a heatsink between the base and the shell, wherein the heatsink has a thermal break defining an upper partition adjacent the shell and a lower partition adjacent the base, and wherein the upper partition and the lower partition each conducts heat through the body of the respective partition and dissipates heat from the LED bulb via a surface area of the upper partition and the lower partition exposed to the environment outside of the LED bulb.

2. The LED bulb of claim 1, wherein the heatsink is made of aluminum.

3. The LED bulb of claim 1, wherein the upper partition has a smaller exposed surface area than the lower partition.

4. The LED bulb of claim 1, wherein the heatsink is made of a metal having a first thermal conductivity and the thermal break is implemented with a connector piece made of a material having a second thermal conductivity that is lower than the first thermal conductivity.

5. The LED bulb of claim 1, wherein the heatsink has a plurality of fins.

6. The LED bulb of claim 1, wherein the driver circuit is thermally coupled to the lower heatsink partition.

7. The LED bulb of claim 1, wherein the LED is thermally coupled to the upper heatsink partition.

8. The LED buld of claim 1, wherein the LED is mounted on an LED mount.

9. The LED bulb of claim 1, wherein the thermal break is a void.

10. The LED bulb of claim 1, wherein the driver circuit is within the lower partition and the base.

11. The LED bulb of claim 1, wherein the driver circuit is thermally coupled to the lower heatsink partition, and wherein the LED is thermally coupled to the upper heatsink partition.

12. A light emitting diode (LED) bulb comprising:
a shell;
an LED within the shell;
a base; and
a heatsink between the base and the shell, wherein the heatsink has a thermal break defining an upper partition adjacent the shell and a lower partition adjacent the base, and wherein the upper partition and the lower partition each conducts heat through the body of the respective partition and dissipates heat from the LED bulb via a surface area of the upper partition and the lower partition exposed to the environment outside of the LED bulb.

13. The LED bulb of claim 12, wherein the heatsink is made of a metal having a first thermal conductivity and the thermal break is implemented with a connector piece made of a material having a second thermal conductivity that is lower than the first thermal conductivity.

14. The LED bulb of claim 12, wherein the thermal break is a void.

15. The LED bulb of claim 12, further comprising:

a driver circuit, wherein the driver circuit is thermally coupled to the lower heatsink partition, and wherein the LED is thermally coupled to the upper heatsink partition.

16. A light emitting diode (LED) bulb comprising:

a shell;

an LED within the shell;

a liquid within the shell;

a base; and a heatsink between the base and the shell, wherein the heatsink has a thermal break defining a first partition adjacent the shell and a second partition adjacent the base, and wherein the first partition and the second partition each conducts heat through the body of the respective partition and dissipates heat from the LED bulb via a surface area of the upper partition and the lower partition exposed to the environment outside of the LED bulb.

17. The LED bulb of claim 16, wherein the heatsink is made of a metal having a first thermal conductivity and the thermal break is implemented with a connector piece made of a material having a second thermal conductivity that is lower than the first thermal conductivity.

18. The LED bulb of claim 16, wherein the thermal break is a void.

19. The LED bulb of claim 16, further comprising:

a driver circuit, wherein the driver circuit is thermally coupled to the second heatsink partition.

20. The LED bulb of claim 16, wherein the LED is thermally coupled to the first heatsink partition.

* * * * *